United States Patent [19]

Laskaris

[11] Patent Number: 4,516,404

[45] Date of Patent: May 14, 1985

[54] FOAM FILLED INSERT FOR HORIZONTAL CRYOSTAT PENETRATIONS

[75] Inventor: Evangelos T. Laskaris, Schenectady, N.Y.

[73] Assignee: General Electric Company, Schenectady, N.Y.

[21] Appl. No.: 595,201

[22] Filed: Mar. 30, 1984

[51] Int. Cl.[3] ..... F17C 1/00

[52] U.S. Cl. ..... 62/45; 62/514 R; 220/901; 220/85 S

[58] Field of Search ..... 62/45, 514 R; 220/85 R, 220/85 S, 85 VR, 85 VS, 901

[56] References Cited

U.S. PATENT DOCUMENTS

| | | | |
|---|---|---|---|
| 3,066,222 | 11/1962 | Poorman et al. | 62/514 R |
| 3,309,884 | 3/1967 | Paulikkonis | 62/45 |
| 3,377,813 | 4/1968 | Mordhorst | 62/45 |
| 3,483,709 | 12/1969 | Biacher et al. | 62/514 R |
| 3,714,942 | 2/1973 | Fischel et al. | 62/45 |
| 4,223,540 | 9/1980 | Longsworth | 62/514 R |

*Primary Examiner*—Ronald C. Capossela

*Attorney, Agent, or Firm*—Lawrence D. Cutter; James C. Davis, Jr.; Marvin Snyder

[57] ABSTRACT

An insert for a horizontal cryostat penetration includes a plurality of foam particles or spheres between which are disposed disks of high thermal conductivity. The spheres or particles are disposed in an annular volume defined by two concentric, thin-wall, low thermal conductivity conduits. This foam filled insert provides thermal insulation and significantly reduces the formation of coolant vapor convection currents in the penetration which would otherwise significantly increase the rate of coolant evaporation from the cryostat. The insert is constructed so that the foam particles are ejected from the penetration upon the buildup of excessive internal pressure. The insert has also preferably one or more string-like lengths of sealing material disposed in a helical pattern about the outer one of the concentric conduits. Accordingly, when this insert is placed within a third conduit, a helical coolant vapor path is formed for insert cooling and exterior ventilation.

24 Claims, 2 Drawing Figures

FOAM FILLED INSERT FOR HORIZONTAL CRYOSTAT PENETRATIONS

BACKGROUND OF THE INVENTION

The present invention is generally directed to horizontal penetrations extending between the inner and outer walls of a cryostat, particularly one employing liquid helium as a coolant material. More particularly, the present invention is directed to an insert for this penetration which employs a large plurality of foam spheres for insulation and blowout protection. Even more particularly, the present invention is directed to a cryostat insert for horizontal penetrations in which electrically conductive leads extend from the penetration in normal operation (that is, non-retractable leads).

In the generation of medical diagnostic images in nuclear magnetic resonance imaging, it is necessary to provide a temporally stable and spatially homogenous magnetic field. The use of superconductive electrical materials maintained at a temperature below their critical transition temperatures provides an advantageous means to produce such a field. Accordingly, for such NMR imaging devices, a cryostat is employed. The cryostat contains an innermost chamber in which liquid helium, for example, is employed to cool the superconductive materials. The cryostat itself typically comprises a toroidal structure with other nested toroidal structures inside the exterior vessel to provide vacuum conditions, intermediate liquid nitrogen cooling and thermal shielding. Since it is necessary to provide electrical energy to the main coil magnet, to various correction coils and to various gradient coils employed in NMR imaging, it is necessary that there be at least one penetration through the vessel walls. Typical prior art penetrations have been vertical. However, from a manufacturing and utilization viewpoint, the construction of vertical penetrations has produced undesirable problems of alignment, assembly and size. However, horizontal cryostat penetrations have not been employed for reasons of thermal efficiency. In particular, it is seen that for a coolant such as liquid helium, that there is a large dependency of density upon temperature. Accordingly, liquid helium vapor found within a vertical penetration is naturally disposed in a layered configuration as a result of density variations from the bottom to the top of the penetration. This layering provides a natural form of thermal insulation along the length of a vertical penetration. In particular, at any position along the axis of such penetration, the temperature profile is substantially constant. However, this would not be the case for a horizontal cryostat penetration since any layering that would result would not be in a direction of the long axis of the cryostat penetration. Accordingly, the temperature gradient along the penetration would tend to set up free convection currents in the vapor within the penetration. This would result in a much more rapid loss of coolant than is desired. Since the cost of helium is relatively high, it is seen that the loss of coolant is undesirable.

Moreover, as a result of an as not yet fully understood phenomenon, it is possible for superconductive windings within a cryostat to undergo a sudden transition from the superconducting state to the normal resistive state. In this circumstance, the electrical energy contained within the coil is rapidly dissipated as resistive ($I^2R$) heating of the windings. This can result in a rapid increase in internal helium vapor pressure and accordingly, cryostat penetrations should usually be provided with pressure relief means. Furthermore, vacuum conditions are maintained between the innermost and outermost cryostat vessels. If for some reason, a loss of vacuum occurs in this volume, it is also possible to develop a rapid increase in the coolant vapor pressure. For this reason also, pressure relief means are desirable for cryostat penetrations.

As indicated above, electrical connection must be provided through the cryostat wall to accommodate the electrical apparatus contained therein at the desired lower temperature. In some cryostat penetration designs, the electrical connections to the internal coils are made through an electrical lead assembly which is disposed entirely within an inner cryostat vessel. In such a configuration, there is a tendency for frost buildup upon the contacts and these contacts often must be heated to a temperature of about 300° K. prior to making an electrical connection to them. It is, of course, undesirable that interior cryostat objects must be heated. It should also be understood that because of the superconducting nature of at least some of coils disposed within the innermost cryostat vessel, a persistent current mode of operation is intended. In such a mode, once desired currents are established, the electrical power supply to the electrical elements within the innermost vessel can be disconnected. This is an advantageous mode of operation since it is highly energy efficient. However, it is seen that this mode of operation exhibits the disadvantage that the electrical leads may have to be heated to provide the desired electrical contact, particularly during start-up excitation of the magnet. However, many of these problems are avoided by providing a non-retractable electrical lead assembly disposed within the penetration. However, the utilization of such a non-retractable assembly introduces insulation, convection current and pressure relief problems which are not present in the retractable lead cryostat design.

Accordingly, it is seen that because of the large density changes between cold and warm helium, vapor free convection secondary flows are easily set up in horizontal cryostat penetrations. These flows considerably degrade the thermal efficiency of the horizontal penetration. If the penetration is densely packed with foam or equipped with a vapor cooled, thermally efficient blowout plug, pressure relief could be obstructed by frost buildup in the vapor cooled channel. It is therefore seen that horizontal cryostat penetrations for NMR magnet cryostats require thermally efficient inserts that suppress free convection vapor flows. These inserts must also provide sufficient exhaust area to relieve internal vessel pressure in case of magnet quench or vacuum loss. Additionally, these inserts must also accommodate non-retractable electrical leads.

SUMMARY OF THE INVENTION

In accordance with a preferred embodiment of the present invention an insert for a horizontal cryostat penetration comprises an outer, low thermal conductivity tube (or conduit) together with an inner, low thermal conductivity tube (or conduit) disposed substantially coaxially with respect to the outer tube. A plurality of foam pieces or spheres is disposed between the inner and outer tubes which are sealably affixed to an annular chamber so as to define an enclosed volume. The annular chamber is provided with blowout means, preferably in the form of a rupture disk. In the event of vacuum loss or magnet quench resulting in coolant vapor pressure buildup, the foam spheres are safely ejected through the broken rupture disk. The annular chamber also preferably includes a means for sealing the space around an electrical conductor extending through the central aperture in the annulus. Thermally conductive baffles are also provided to partition the foam spheres into a plurality of annular volumes.

In accordance with another preferred embodiment of the present invention, the insert described briefly above is employed in a horizontal cryostat penetration assembly which further includes a thin wall stationary tubular conduit disposed sealably between inner and outer cryostat vessel walls. Accordingly, the outer surface of the outer tube in the above-described insert preferably includes helically machined grooves therein for the purpose of holding an elongate strip of sealing material such as twine. This configuration produces a helical coolant vapor flowpath between the stationary and removable portions of the cryostat penetration. The insert and insert assembly of the present invention are particularly useful in liquid helium cryostats employing non-retractable electrical leads. The insert and assembly of the present invention are particularly applicable for temporary utilization during magnet excitation.

Accordingly, it is an object of the present invention to provide a thermally efficient cryostat penetration insert and insert assembly that can reliably relieve the internal vessel pressure.

It is also an object of the present invention to provide a temporary cryostat penetration in which free convection secondary flows are greatly suppressed.

It is a still further object of the present invention to provide a cryostat penetration insert that is not obstructed by frost buildup in the channel in which it is disposed.

It is yet another object of the present invention to provide a thermally efficient insert and insert assembly for a horizontal cryostat penetration that can exhaust cold helium vapor through a curved passage when the helium vapor vessel pressure is exceeded and is particularly usable during the excitation of superconducting magnets contained within the cryostat.

DESCRIPTION OF THE FIGURES

The subject matter which is regarded as the invention is particularly pointed out and distinctly claimed in the concluding portion of the specification. The invention, however, both as to organization and method of practice, together with further objects and advantages thereof, may best be understood by reference to the following description taken in connection with the accompanying drawings in which:

DETAILED DESCRIPTION OF THE INVENTION

Figures 1, 2:
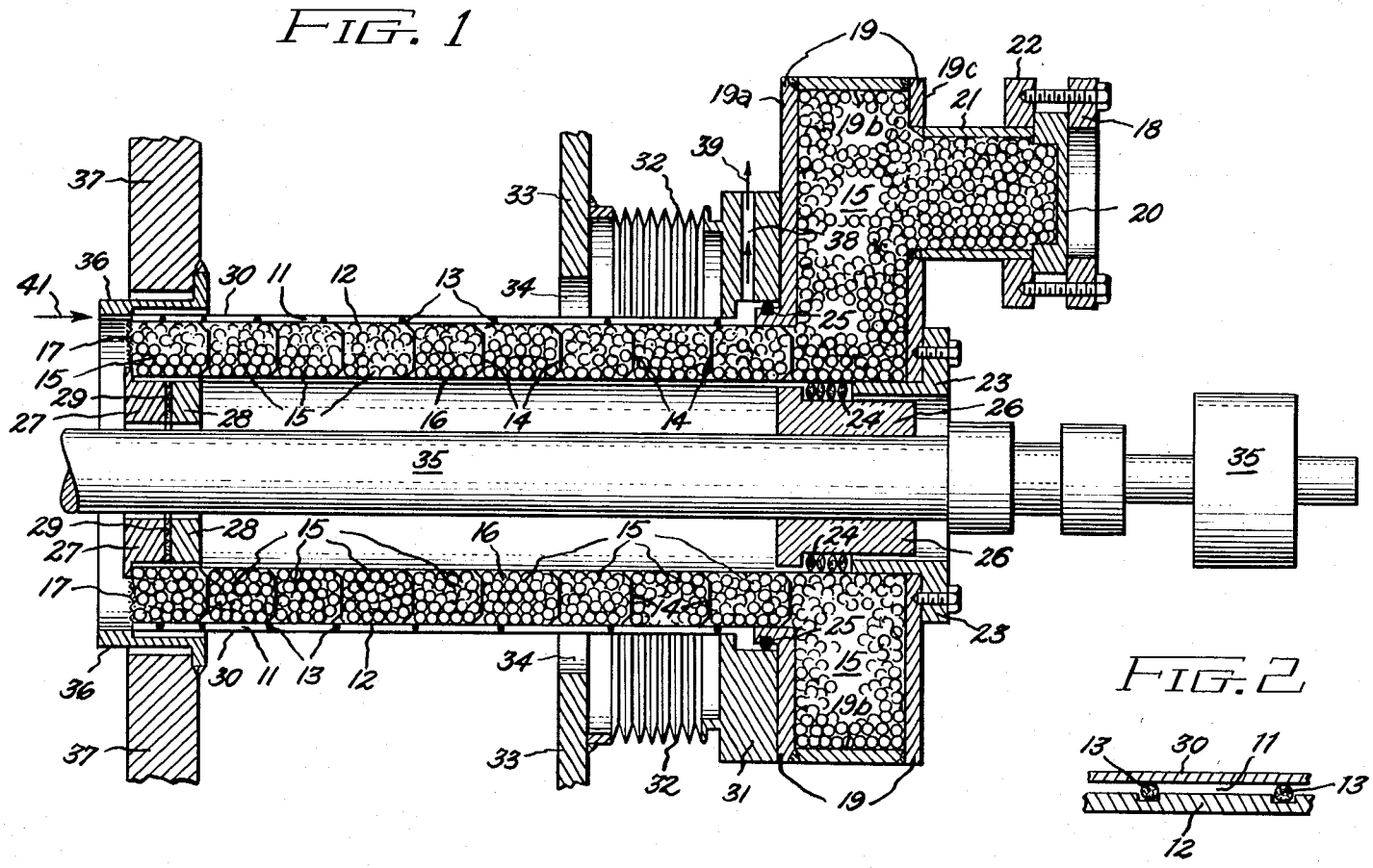
FIG. 1 is a cross-sectional, side elevation view illustrating the insert and penetration assembly of the present invention.
FIG. 2 is an enlarged cross-sectional side elevation view of a small portion of the penetration assembly of the present invention illustrated in FIG. 1.

The preferred embodiment of the present invention is illustrated in FIG. 1. In particular, FIG. 1 illustrates a horizontal cryostat penetration in which there are shown two distinct and separable assemblies. The particular elements which comprise these two assemblies are described in detail below. Suffice it to say for now that the two assemblies essentially comprise the stationary parts of the cryostat itself and the removable insert assembly in accordance with one embodiment of the present invention.

The elements comprising the stationary cryostat itself are considered first. In particular, the cryostat includes inner vessel wall 37 and outermost vessel wall 33 with aperture 34 therein through which the penetration assembly of the present invention is disposed. In operation, vacuum conditions are maintained between these walls. Furthermore, while FIG. 1 illustrates the presence of a limited number of vessel walls, it should be understood that other intermediate vessel walls may be provided as circumstances dictate in various cryostat designs. To accommodate thermal expansion and contraction effects, bellows assembly 32 is typically disposed between outermost vessel wall 33 and flange 31. Wall 37 and flange 31 are both provided with aligned apertures for accommodation of the horizontal penetration. More particularly, collar 36 is typically disposed in an aperture in wall 37 and is sealed to wall 37 for example, by welding. Inner vessel wall 37 and collar 36 typically comprises materials such as aluminum. Outmost vessel wall 33 and flange 31 typically comprise a low thermal conductivity material such as stainless steel. The stationary cryostat structure also includes fixed tubular conduit 30 which passes at least partially through apertures in walls 37 and 33. Additionally stationary conduit 30 is sealably joined to walls 37 and flange 31. In particular, in the case of wall 37, tubular conduit 30 is adjoined thereto by means of collar 36. Stationary tubular conduit 30 typically comprises a low thermal conductivity material such as stainless steel. Lastly, as shown in FIG. 1, the stationary cryostat structure includes non-retractable electrical lead 35. Accordingly, it is seen that walls 33 and 37, flange 31, collar 36, electrical lead 35 and conduit 30 comprise a stationary structure for which the insert assembly of the present invention may be employed.

The remaining structures of FIG. 1 comprise the insert or insert assembly of the present invention. In particular, the insert assembly of the present invention includes outer tube 12, inner tube 16, annular chamber 19, foam particles or spheres 15, rupture disk 20 and other structures which are more particularly described below. In particular, it is seen that the utilization of annular chamber 19 permits the disposition therethrough of electrical conduit 35. However, while conduit 35 is described herein as a single electrical lead, it is nonetheless understood that this lead provides electrical connection for a number of internal electrical components including the magnet coils, correction coils and gradient coils, as needed or desired in various applications, including NMR diagnostic imaging. The use of an annular exterior chamber 19 in the manner illustrated in FIG. 1 is also at least partially motivated by the general undesirability of employing annular blowout or rupture disks.

The elements comprising the removable insert or insert assembly of the present invention are now particularly discussed. In particular, FIG. 1 illustrates outer thin wall tube 12 which is sealably attached to washer-shaped wall 19*a* of annular chamber 19. Inner thin wall tube 16 is also sealably affixed to a wall of chamber 19, namely washer-shaped wall 19*c*. Tube 16 is preferably aligned so as to be coaxial with tube 12 so as to define an annular volume therebetween. This volume is preferably filled with foam pieces or spheres 15 typically having a diameter of approximately 1/16 to ⅛ inch. These spheres provide an insulating function and yet at the same time may be safely ejected from any holes occurring in burst disk 20. These spheres also preferably fill the interior volume of annular chamber 19. Also disposed within the volume between tubes 12 and 16 are a plurality of high thermal conductivity disks 14. These disks preferably comprise copper or aluminum foil in contact with tubes 12 and 16. These annular baffles help to prevent free convection currents of helium vapor from establishing themselves in the horizontal penetration. These baffles provide isothermal surfaces, limit vapor flow and generally reduce temperature gradients in a transverse direction in the penetration. Baffles 14 may be designed so as to be sufficiently thin so as to be ejected with spheres 15 or may be provided with sufficient rigidity that over pressure conditions result in these baffles being forced against wall 19*c* of chamber 19. Tubes 12 and 16 preferably comprise low thermal conductivity material and for similar reasons, also comprise thin walled sections.

Annular chamber 19 includes annular member 19*a* to which tube 12 is sealably joined, as for example, by welding. Chamber 19 also includes annular member 19*c* to which tube 16 is attached, again for example, as by welding. Cylindrical member 19*b* also comprises chamber 19 and it is wall member 19*b* to which annular members 19*a* and 19*c* are sealably attached, again preferably by welding. Annular disk-shaped member 19*c* is therefore seen to be possessed of an aperture having a smaller diameter than the aperture in wall 19*a*. Accordingly, annular chamber 19 is seen to possess an inner aperture through which electrical conduit 35 may be disposed. It is also seen that chamber 19, and in particular wall 19*a*, includes an annular groove in which O-ring 25 is disposed so that chamber 19 may be sealably affixed to vessel flange 31.

It is also seen that annular screen 17 is attached to tubes 12 and 16 as a means for containing spheres 15, to the extent that such retention is not in fact accomplished by means of baffles 14. Screen 17 is therefore seen to preferably comprise a member which is readily penetrable by a gaseous flow.

Collar 21 with flange 22 is sealably affixed in an aperture in wall member 19*c* of annular chamber 19. Annular retention clamp 18 is affixed to flange 22 so as to hold rupture disk 20 in position so as to provide an airtight seal. The inner volume of chamber 19 is also preferably filled with foam spheres 15, as shown. In the event that rupture disk 20 is broken as a result of overpressure conditions, spheres 15 are safely but rapidly ejected from the insert assembly. The spheres themselves, may for example, comprise material such as styrofoam and are preferably about 1/16 to ⅛ inch in diameter.

It is also desirable to employ sealing and support means for electrical lead 35. To this end, split ring support collar 26, together with a matching split ring collar half, is disposed about conductor 35, as shown. Split ring collar 26 is also seen as being disposed with in the central aperture of annular chamber 19. Also seen in FIG. 1 is that flanged collar 23 bolted to wall member 19*c* of chamber 19 is also provided so that split ring collar 26 may extend at least partially therethrough. To provide the desired sealing function, a spirally configured length of sealing material, such as a strip of leather 24, is disposed in contact with split ring collar 26, flanged collar 23 and inner tube 16 as shown.

At the cold end of the cryostat insert, conductor 35 is seen to be supported with a sealing plug assembly comprising split rings 27 and 28 between which is disposed gasket 29, preferably comprising leather.

Another important feature of the present invention that is illustrated in FIG. 1 is that there is disposed about the exterior of outer tube 12, a string-like length of sealing material 13 arranged in a substantially helical pattern between outer tube 12 and stationary tube 30. Sealing material 13 may comprise gasket material or may simply comprise a length of twine. It is additionally noted that FIG. 1 depicts sealing material 13 as being disposed in a helical pattern exhibiting a variable pitch. In particular, sealing material 13 is disposed so that the pitch of the helical pattern increases in a direction extending from inner vessel wall 37 to outer vessel flange 31. It is also noted that while it is possible to dispose sealing material 13 in a single helical pattern, it is also possible to employ one or more lengths of sealing material disposed in a double or triple helical pattern. In either case, it is seen that sealing material 13 provides a helical flowpath for coolant vapor from the interior to the exterior of the cryostat. In particular, FIG. 1 illustrates coolant flow arrow 41 directed to the start of the helical path which extends around and along gap 11 between tubes 12 and 30. By providing a flowpath in this configuration, several advantages are achieved. In particular, the temperature throughout any cross-section along the axial length of the penetration insert is much more constant. This temperature distribution is useful in the prevention of the establishment of free convection current flowpaths for the coolant vapor in the penetration. It is further seen that the coolant vapor exits the exterior end of gap 11 and is ultimately exhausted to the ambient environment through channel 38 in wall 31, as indicated by flow arrow 39. It is also, in particular, noted that this flowpath is not in fluid communication with the interior annular volume between tubes 12 and 16, that is the volume occupied by spheres 15 (except at the cold, interior end of the of the penetration insert). Accordingly, the axial and circumferential flow occurring in gap 11 is not shared by the vapor surrounding spheres 15. It is also seen that chamber 19 together with tubes 12 and 16 and the helically disposed sealing material 13 are readily removable from the cryostat.

Since several of the structures shown in FIG. 1 are in fact thin-walled structures, clarity of illustration is enhanced in FIG. 1 by the depiction of these elements as single lines. In particular, this is true of stationary tube 30, outer tube 12 and inner tube 16. Accordingly, FIG. 2 provides an enlarged cross-sectional view of a portion of the thin-walled structure employed herein. All the elements illustrated in FIG. 2 have been described above. However, it is notable to observe that sealing material 13 may in fact be disposed in helical grooves provided in outer tube 12. Such a construction facilitates removal of the insert assembly of the present invention. However, those skilled in the art will readily appreciate that it is also possible to provide stationary tube 30 with similar helically disposed grooves. However, such is not the preferred embodiment of the present invention.

Those skilled in the art will also appreciate that while the above description has been provided under the assumption that the penetration exhibits a circular cross-section, that other cross-sections are possible. However, for ease of understanding and construction, cylindrical structures are preferred. Accordingly, as used herein and in the appended claims, the term tube or tubular is not restricted to objects exhibiting circular cross-sections, but also includes cylindrical (in its general sense) structures having oval, elliptical, square and similar cross-sections. Accordingly, chamber 19 is also described above as being annular. However, it is well understood that departure from this shape too is readily provided in the same fashion without departing from the principles of the of present invention.

It should be noted herein that while the low thermal conductivity materials for the tubes or tubular conduits discussed above include such materials as stainless steel and glass fiber composites, it is also possible to employ such materials as titanium and nylon, or plastic materials exhibiting a low thermal conductivity. In particular, for the purposes of machining grooves in outer tube 12, this tube 12 preferably comprises a glass fiber composite material.

In terms of physical dimensions, gap 11 between conduits 30 and 12 is typically between about 2 mils and about 10 mils. Thermally conductive baffles 14 are typically between about 1 and about 5 mils in thickness and comprise high thermal conductivity material such as copper or aluminum foil.

It is to be particularly noted that, in normal operation, vapor present around spheres 15 is not exhausted to the external environment. Therefore, back diffusion of water vapor into this volume is not possible. Consequently, even if frost develops in gap 11, the volume occupied by the spheres 15 remains essentially free of frost. This insures that the spheres are readily ejectable upon rupture of disk 20.

From the above, it may be appreciated that the penetration insert assembly of the present invention provides a thermally efficient horizontal cryostat penetration which is particularly useful for non-retractable electrical leads. In particular, it is seen that the present invention significantly mitigates any effects resulting from free convection secondary flows in the penetration itself. It is also seen that the present invention provides a high degree of thermal insulation in a manner which does not impede the exhaust of coolant gasses in the event of magnet quench or vacuum loss. In short, the present invention provides a thermally efficient horizontal cryostat penetration insert assembly that reliably relieves internal vapor pressure.

While the invention has been described in detail herein in accord with certain preferred embodiments thereof, many modification and changes therein may be effected by those skilled in the art. Accordingly, it is intended by the appended claims to cover all such modifications and changes as fall within the true spirit and scope of the invention.

The invention claimed is:

1. An insert for horizontal cryostat penetration comprising:

an outer, low thermal conductivity tube;

an inner, low thermal conductivity tube disposed substantially coaxially with respect to said outer tube;

a plurality of foam pieces disposed between said inner and outer tubes;

an annular chamber sealably affixed to said inner and outer tubes so that the interior volume of said chamber is in flow communication with the volume between said inner and outer tubes containing said foam particles; and blowout means in flow communication with the interior of said annular chamber.

2. The insert of claim 1 further including means, in the central aperture of said annular chamber, to provide an airtight seal against an electrical lead extending, from said cryostat, within said inner tube and extending through the aperture in said annular chamber.

3. The insert of claim 1 in which said blowout means comprises a rupture disk.

4. The insert of claim 1 further including a plurality of annular thermally conductive baffles disposed so as to divide the volume between said inner and outer tubes into a plurality of annular volumes containing said foam pieces.

5. The insert of claim 4 in which said baffles comprise material selected from the group consisting of copper and aluminum.

6. The insert of claim 4 in which said baffles are between approximately 1 mil and 10 mils in thickness.

7. The insert of claim 4 in which said baffles are in thermal contact with said inner and outer tubes.

8. The insert of claim 1 further including screen means to retain said foam pieces between said inner and outer tubes, said screen means being disposed at the end of said tubes opposite the end at which said annular chamber is affixed.

9. The insert of claim 1 in which a plurality of foam pieces is also disposed within the inner volume of said annular chamber.

10. The insert of claim 1 in which said foam pieces exhibit a substantially spherical shape.

11. The insert of claim 10 in which said spheres are approximately 1/16 to ⅛ inch in diameter.

12. The insert of claim 1 in which said foam pieces comprise styrofoam.

13. The assembly of claim 1 in which said inner tube comprises material selected from the group consisting of stainless steel, glass fiber, titanium and nylon.

14. The assembly of claim 1 in which said outer tube comprises material selected from the group consisting of stainless steel, glass fiber, titanium and nylon.

15. The assembly of claim 1 in which said tubes exhibit a substantially circular cross-section.

16. A horizontal penetration assembly for a cryostat having an inner vessel wall and an outer vessel wall comprising:

a stationary tube passing at least partially through an aperture in said inner vessel wall and an aperture in said outer vessel wall, said stationary tube being sealably joined to said inner and outer vessel walls;

an insert assembly disposed within said stationary tube so as to be substantially coaxial with said stationary tube, said insert assembly including an outer, low thermal conductivity tube; an inner, low thermal conductivity tube disposed substantially coaxially with respect to said outer low thermal conductivity tube; a plurality of foam pieces disposed between said inner and outer low thermal conductivity tubes; an annular chamber sealably affixed to said inner and outer tubes so that the interior volume of said chamber is in flow communication with the volume between said inner and outer tubes containing said foam particles; and blowout means in flow communication with the interior of said of annular chamber;

at least one string-like length of sealing material disposed in a helical pattern between said stationary tube and said outer tube so as to define a helical flow path therebetween, said path being in flow communication with the interior of said inner vessel.

17. The assembly of claim 16 in which said sealing material is disposed in grooves along the exterior of said outer tube.

18. The penetration assembly of claim 16 in which the pitch of said helix increases in the direction from the inner vessel wall to said outer vessel wall.

19. The penetration assembly of claim 16 in which said sealing material comprises twine.

20. The penetration assembly of claim 16 in which said helical path is also in flow communication with the volume exterior to said outer cryostat vessel wall.

21. The penetration assembly of claim 16 in which a plurality of string-like lengths of sealing material are disposed in an equal plurality of helical patterns between said stationary tube and said outer tube so as to define a plurality of parallel helical paths therebetween.

22. The assembly of claim 16 in which the space between said stationary tube and said outer tube is between about 2 mils and about 10 mils.

23. The assembly of claim 16 in which said stationary tube comprises material selected from the group consisting of stainless steel, glass fiber, titanium and nylon.

24. The assembly of claim 16 in which said tubes exhibit a substantially circular cross-section.

* * * * *